US006920844B1

(12) United States Patent
Ismert

(10) Patent No.: US 6,920,844 B1
(45) Date of Patent: Jul. 26, 2005

(54) THERMAL EXPANSION ARRESTER FOR WATER HEATERS

(75) Inventor: Joseph P. Ismert, Kansas City, MO (US)

(73) Assignee: Sioux Chief Manufacturing Co., Inc., Peculiar, MO (US)

( * ) Notice: Subject to any disclaimer, the term of this patent is extended or adjusted under 35 U.S.C. 154(b) by 18 days.

(21) Appl. No.: 10/819,468

(22) Filed: Apr. 7, 2004

(51) Int. Cl.[7] ..... F22B 37/47
(52) U.S. Cl. ..... 122/14.3; 122/504
(58) Field of Search ..... 122/14.3, 14.31, 122/14.1, 504, 506

(56) References Cited

U.S. PATENT DOCUMENTS

| | | | | |
|---|---|---|---|---|
| 1,338,760 | A | | 5/1920 | Wells |
| 3,381,110 | A | | 4/1968 | Fischer |
| 3,581,057 | A | | 5/1971 | Meyers |
| 3,754,563 | A | | 8/1973 | Boals |
| 3,891,124 | A | | 6/1975 | Dreibelbis |
| 4,819,698 | A | | 4/1989 | Ismert |
| 4,862,834 | A | | 9/1989 | Kurz |
| 4,906,817 | A | | 3/1990 | Kurz |
| 4,930,551 | A | | 6/1990 | Haws |
| 4,990,746 | A | | 2/1991 | Hammond |
| 5,555,997 | A | | 9/1996 | Nogles |
| 5,584,316 | A | * | 12/1996 | Lund ..... 137/337 |
| 5,690,061 | A | | 11/1997 | Lopez |
| 6,041,742 | A | * | 3/2000 | Drake ..... 122/14.1 |
| 6,418,969 | B1 | | 7/2002 | Bertagna |

FOREIGN PATENT DOCUMENTS

| | | | |
|---|---|---|---|
| GB | 2273972 | A | 7/1994 |

* cited by examiner

*Primary Examiner*—Gregory Wilson
(74) *Attorney, Agent, or Firm*—Erickson & Kleypas, L.L.C.

(57) ABSTRACT

A thermal expansion arrester for positioning within the tank of a water heater comprises a rigid tube maintaining a compressible volume of gas between first and second closure members wherein at least one of the closure members comprises a piston that is slidably and sealingly secured within the tube. In a preferred embodiment both closure members comprise pistons held in the tube by crimping its ends. In an uncompressed state the pressure of the gas within the tube is sixty psig.

20 Claims, 2 Drawing Sheets

THERMAL EXPANSION ARRESTER FOR WATER HEATERS

BACKGROUND OF THE INVENTION

1. Field of the Invention

The present invention relates to thermal expansion arresters utilizing a compressible volume of air to prevent or relieve the build up of pressure in hot water systems.

2. Description of the Related Art

Numerous devices have been developed to relieve the pressure caused by the thermal expansion of water within a hot water system such as is associated with water heaters in most houses and residential buildings. Most residential building codes require that check valves or backwater valves be installed on the incoming water line for buildings to prevent the downstream potable water system from being contaminated if back pressure is created due to a line break or use of fire hydrants. With a check valve on the water inlet and all of the downstream valves or faucets in a residence or building closed, most residential water systems become closed systems. The pressure within such a closed system can increase significantly due to thermal expansion of the water upon heating. In situations in which most of the heated water in the water heater is drained out so that the water heater is filled with relatively cold water, which is then allowed to heat back up to the water heater thermostat set point, the volume of the water in a conventional residential forty gallon water heater can expand by as much as a gallon.

The increased pressure resulting from this expansion in volume can cause damage to or blow out seals on downstream faucets or even cause a rupture in the hot water tank if some form of pressure relief system is not provided. Although water heaters generally incorporate a pressure relief valve to prevent excessive pressure buildups, release of these valves results in a generally uncontrolled release of water from the water heater which can cause damage to surrounding walls or individuals. Further once a pressure relief valve is tripped, it may not seal properly again providing a continuous leak.

Numerous types of expansion chambers have been developed incorporating a volume of air which will compress to allow expansion of the heated water. For example, U.S. Pat. No. 6,418,969 discloses an in-line expansion tank which may be mounted to the incoming cold water supply line (downstream of any check valve) to permit thermal expansion of heated water out of the water heater tank. However, the in-line expansion tank shown would be relatively expensive to manufacture.

It is also known to use devices similar in construction to the water hammer arrester shown in U.S. Pat. No. 4,819,698 upstream or downstream of the water heater to provide a compressible volume of air maintained within a tube by a piston whose outer face is in communication with the water system. Increases in pressure in the water line act against the piston and compress the volume of air maintained within the tube allowing the expanded volume of water to expand into the tube. However, such commercially available devices have limited volumetric capacity, insufficient to accommodate relatively large increases in pressure occurring when the water heater is completely drained and the cold replacement water is heated up to the thermostat set point, comprising a rise of approximately one hundred degrees Fahrenheit. The relatively expensive, thick-wall construction of the tube of these types of devices is necessary to prevent the tube from being dented and creating a stop limiting the range of motion of the piston and the volume into which the heated water can expand.

It is also known to mount compressible bladders within a water heater. For example, U.S. Pat. No. 6,041,742 discloses a water heater having a collapsible bladder suspended in the tank of a water heater to accommodate thermal expansion of the water in the tank. However, these devices must be connected to an air replenishing valve located outside of the tank as the bladder walls are semi-permeable and slowly lose air. The rubber or synthetic bladders used in such systems are also prone to break down or disintegrate over time rendering the bladders inoperable and producing material or particles which can clog downstream faucets, valves and the like. There remains a need for a reliable thermal expansion system for water heaters which is relatively inexpensive to manufacture, resistant to pressure loss, damage and wear and less expensive to install.

SUMMARY OF THE INVENTION

In the present invention a compressible air space is provided in the tank of a water heater by suspending a rigid, gas filled tube with sealed ends within the tank wherein at least one of the ends comprises a piston. In an uncompressed state, the gas in the tube is at a pressure of approximately 60 psig, which closely approximates the static pressure in residential plumbing systems. This pressure is utilized to maximize the volume of the arrester as built. As the pressure in the tank exceeds 60 psig, due to thermal expansion, the expanding water presses the piston inward compressing the gas in the tube and increasing the space available for the expanded water. In a preferred embodiment, the tube is approximately four inches in diameter and thirty-six inches in length to provide a pressurized, working volume of two gallons.

DETAILED DESCRIPTION OF THE PREFERRED EMBODIMENTS

Figure 1:
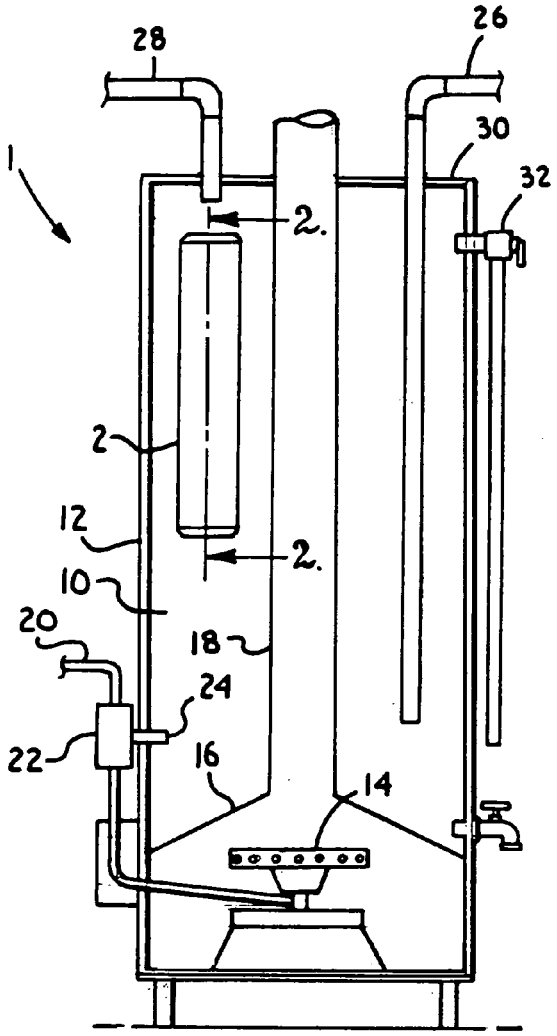
FIG. 1 comprises a cross-sectional view of a conventional water heater with a thermal expansion arrester of the present invention positioned in a tank of the water heater.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, FIG. 1 shows a cross-sectional view of a gas water heater 1 of a conventional design incorporating a thermal expansion arrester or tube 2 of the present invention. The water heater 1 includes a hot water tank 10 with an insulating jacket 12 extending therearound. A gas burner 14 is mounted below the tank 10 and a hood 16. The hood 16 directs the hot combustion gasses through a flue 18 extending centrally through the tank 10 and out the top of the water heater 1.

Gas is supplied to the gas burner 14 through gas supply line 20 which passes through a thermostat or thermostatic control device 22. The thermostat 22 controls the flow of gas to the burner 14 in response to temperature readings taken by a temperature probe 24 extending into tank 10.

A cold water inlet pipe 26 and a hot water outlet pipe 28 extend through the top 30 of the tank 10. The water inlet pipe 26 extends inside the tank 10 and includes an open end positioned near the bottom of the tank 10 proximate the hood 16. Water entering the tank 10 through the water inlet pipe 26 is heated by the burner 14. The heated water rises to the top of the tank 10 and exits the tank 10 through the hot water outlet pipe 28 on demand.

As the water in the tank 10 is heated it expands in volume. In most municipal water systems, the expanded volume of water is prevented from expanding back through the inlet pipe 26 by a check valve located at the water meter (not shown). If the faucets and valves downstream of the water heater 1 are all closed and no other pressure relief system is provided, pressure will build up in the water heater tank 10. The water heater 32 does include a pressure relief valve 32 which trips or opens if the pressure in the tank 10 reaches a set pressure, set below the pressure at which significant damage might be caused. However, as discussed previously, it is undesirable to have the pressure relief valve 32 trip open.

Figure 2:
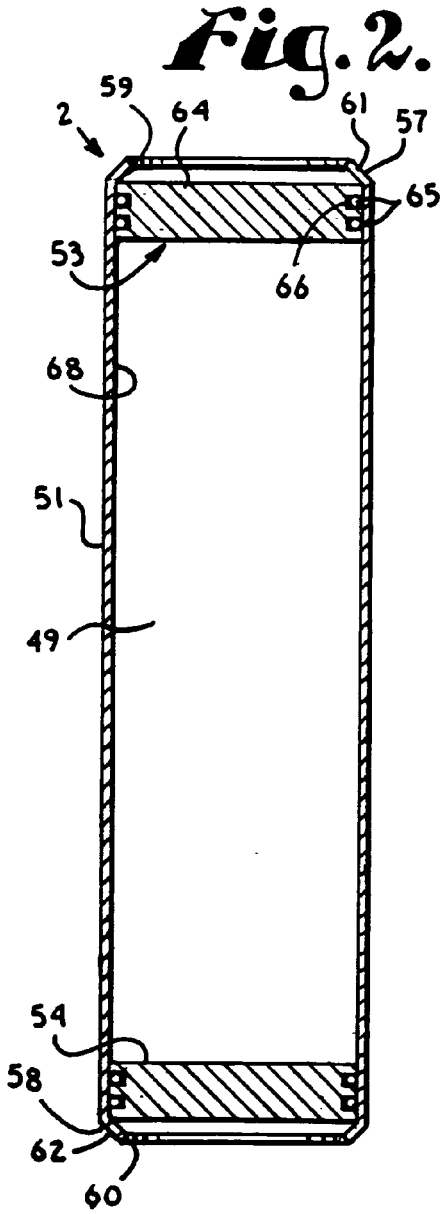
FIG. 2 is an enlarged cross-sectional view of the thermal expansion arrester taken generally along line 2—2 of FIG. 1.

The thermal expansion arrester 2, as shown in more detail in FIG. 2, is installed in the tank 10 of the water heater 1. The arrester 2 includes a confined volume of gas 49 which is compressed and reduced as the volume of the water in the tank 10 increases due to heating, thereby preventing the pressure in the tank from exceeding the set point on the pressure relief valve 32. The preferred gas is air, but other suitable gasses may be utilized including nitrogen.

Figure 3:
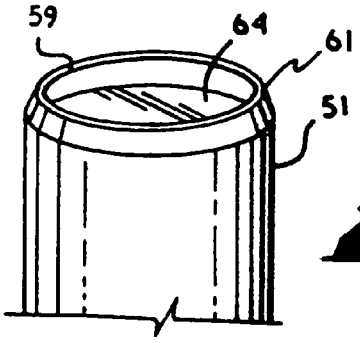
FIG. 3 is an enlarged and fragmentary perspective view of the thermal expansion arrester as shown in FIG. 1.

Referring to FIGS. 2 and 3, the thermal expansion arrester 2 generally comprises a cylindrical tube or housing 51 with first and second pistons 53 and 54 secured therein by crimping the first and second ends 57 and 58 of the tube 51 while leaving openings or holes 59 and 60 in the ends of the tube 51. The first and second pistons 53 and 54 generally function as closure members, closing off the ends of the tube 51 and holding the volume of compressible gas therein. The cylindrical tube 51 is preferably formed from a relatively thin wall of stainless steel, approximately 0.035 inches thick. The tube 51 is preferably approximately four inches in diameter and thirty-six inches long.

The crimped ends 57 and 58 of tube 51 may be referred to as first and second stops 61 and 62. The volume of pressurized gas 49 is maintained between the pistons 53 and 54, and the stops 61 and 62 hold the pistons 53 and 54 within the tube 7. 51 against the pressure of the pressurized gas. Each of the pistons 53 and 54 comprises a piston body 64 and at least two O-rings 65 positioned in O-ring grooves 66 formed in the piston body 64. The piston bodies 64 are preferably formed from a heat resistant material water impervious material, such as glass filled poly propylene. The O-rings 65 are preferably formed from a self-lubricating, resilient material such as EDPM (a terpolymer elastomer made from ethylene-propylene diene monomer). The O-rings form a watertight and airtight seal between an inner surface 68 of the tube 51 and the pistons 53 and 54. The piston bodies 64 and O-rings 65 are sized to permit the pistons to slide relative to the inner surface of the tube 51 while maintaining a watertight and airtight seal therebetween.

The thermal expansion arrester 2 is formed in a machine having a chamber which may be pressurized. A stainless steel tube 51 is inserted in the chamber and the first end 57 is crimped by a dye to form the first stop 61. The first piston 53 is then inserted in the tube 51 through the second end 58 and the chamber is pressurized to approximately sixty psig. The second piston 54 is then inserted in the second end 58 of the tube 51 and the second end 58 is crimped to form the second stop 62. The pressure of the air trapped within the tube 51 is thereby approximately sixty pounds per square inch with the pistons 53 and 54 pushed outward against the stops 61 and 62.

FIG. 3 shows an alternative embodiment 70 of the thermal expansion arrester 2 comprising a tube 71 and a single piston 73. A first end 75 of the tube 71 is closed either by welding, spinning or otherwise forming a cap 77 across the end 75. The closed end or cap 77 of tube 71, whether formed by a separate piece of material welded on to the tube 71 or formed by spinning the first end 75 of the tube closed or closing the tube by other means, may be referred to as a closure member. A second end 79 of the tube 71 is crimped forming a stop 81 to hold the piston 73 therein against the force of pressurized gas held within the tube 71. The thermal expansion arrester 70 is formed in a manner similar to that by which thermal expansion arrester 2 is formed, except that the first end of the tube 71 is closed in a different manner. The thermal expansion arrester 70 operates in a manner similar to that of thermal expansion arrester 2 as described below, with only the single piston 73 of thermal expansion arrester 70 being acted upon by the increasing pressure of the water in the tank 10 upon heating.

The thermal expansion arrester 2 or 70 is preferably installed within the tank 10 of a water heater 1 during assembly of the water heater 1. It is not necessary to attach the thermal expansion arrester 2 to anything within the tank 10. Rather the thermal expansion arrester 2 may float freely within the tank 10 upon filling of the tank 10.

Upon heating of the water in the tank 10, as the pressure in the tank 10 exceeds the pressure of the trapped gas in the tube 51, the pressurized water acts on the pistons 53 and 54 through the openings 59 and 60 in the end of the tube 51. The pressurized water urges the pistons 53 and 54 inward further compressing the pressurized air trapped between the pistons 53 and 54 and accommodating the expansion of the water in the tank 10 to maintain the pressure of the water in the tank 10 below the set point pressure of the pressure relief valve 32. The tube 51 is preferably sized to accommodate the maximum volumetric expansion of water in the water heater 1 when the entire contents of the tank 10 are heated from the water inlet temperature (approximately 55 degrees Fahrenheit) to the maximum temperature setting for the water heater 1. For example, in a conventional water heater having a capacity of approximately 40 gallons, the thermal expansion arrester 2 is sized to keep system pressures below 145 psig by absorbing an expansion of approximately one gallon of water through the compression of the pistons 53 and 54 inward, when the temperature of the water in the system rises approximately 100 degrees Fahrenheit from 55 to 155 degrees Fahrenheit.

One of the advantages of the thermal expansion arresters 2 and 70 is that they do not have to be connected to anything and can simply float within the tank 10 of the water heater. It is not necessary to connect the arresters 2 or 70 to the tank 10 of the water heater 1, nor is it necessary to connect the arresters 2 or 70 to any of the water lines or a make-up air line to recharge the arrester.

Figure 4:
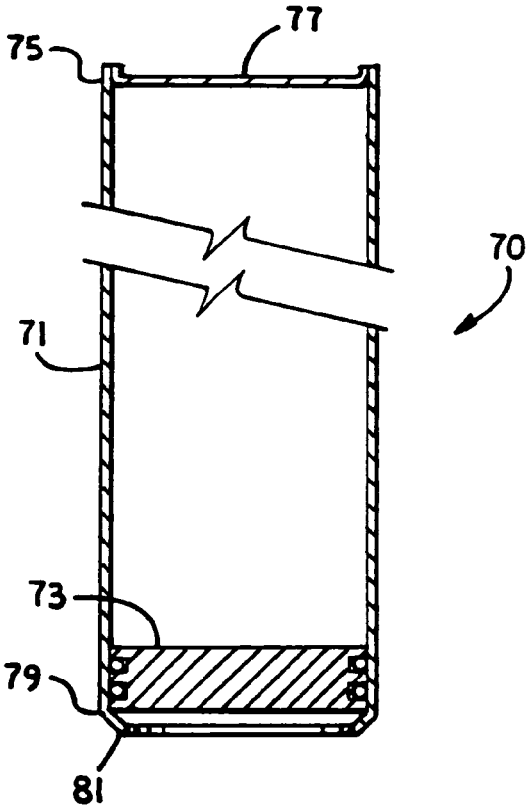
FIG. 4 is a fragmentary, cross-sectional view of an alternative embodiment of the thermal expansion arrester.
Figure 5:
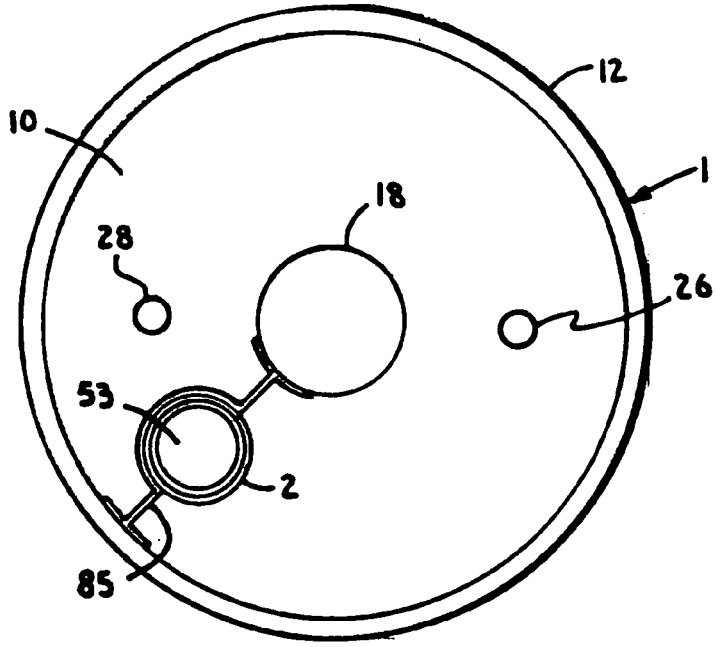
FIG. 5 is a diagrammatic, cross-sectional view looking downward of a water heater similar to that shown in FIG. 1 showing a thermal expansion arrester connected to the water heater by a mount extending between an inner surface of the water heater tank and a water heater flue.

However, it is foreseen that the arrester 2 could be attached, connected or secured to structure within the water heater 1 to hold it in place. For example, the arrester 2 may be supported in place by a hangar (not shown) secured to and extending from the top 30 of the water heater 1. Alternatively the arrester 2 may be supported by a mount 85 (shown diagrammatically in FIG. 4) supported between the inner surface of the tank 10 and the outer surface of the flue 18.

It is to be understood that while certain forms of the present invention have been illustrated and described herein, it is not to be limited to the specific forms or arrangement of parts described and shown. For example, it is foreseen that the thermal expansion arresters 2 or 70 could be installed in the tank 10 after the water heater 1 has been assembled, in which case an access opening or door may have to be provided in the water heater 1 to permit later installation or removal of the thermal expansion arresters 2 or 70. It is also to be understood that although preferred materials of construction have been disclosed, the claims are not to be limited to such materials of construction unless specifically set forth in the claims. In addition, although the tubes 51 and 71 shown are cylindrical, it is foreseeable that tubes of other cross-sectional geometries could be utilized. In addition although the drawings show use of the thermal expansion arresters 2 and 70 in association with a gas water heater, it is to be understood that the arresters 2 and 70 could be utilized with other types of water heaters including for example electric or solar.

What is claimed and desired to be secured by Letters Patent is as follows:

1. A thermal expansion arrester for positioning within a tank of a water heater, said thermal expansion arrester comprising:

a) a tube having a compressible volume of gas maintained therein between first and second closure members wherein at least said first closure member is slidably and sealingly secured within said tube.

2. The thermal expansion arrester as in claim 1 sized to maintain pressure in the tank of the water heater below approximately 145 psig while accommodating a volumetric expansion of the water in the tank associated with a rise in the temperature of the water by approximately 100 degrees Fahrenheit.

3. The thermal expansion arrester as in claim 1 wherein said closure member comprises a first piston having at least two O-rings extending around a piston body to form an airtight and watertight seal between said first piston and an internal surface of said tube.

4. The thermal expansion arrester as in claim 1 wherein said first closure member is secured within said tube by a first stop formed near a first end of said tube.

5. The thermal expansion arrester as in claim 4 wherein said first stop comprises an inwardly projecting rim of said tube.

6. The thermal expansion arrester as in claim 1 wherein said second closure member is slidably and sealingly mounted within said tube.

7. The thermal expansion arrester as in claim 6 wherein each of said first and second closure members comprises a piston having at least two O-rings extending around a piston body to form an airtight and watertight seal between said respective first and second piston and an internal surface of said tube.

8. The thermal expansion arrester as in claim 6 wherein said second closure member is secured within said tube by a second stop formed near a second end of said tube.

9. A method of accommodating the expansion of water within a tank of a water heater as the water is heated comprising the step of:

a) positioning within the tank a tube having a compressible volume of gas maintained therein between first and second closure members wherein at least one of said closure members is slidably and sealingly mounted within said tube.

10. The thermal expansion arrester as in claim 9 sized to maintain pressure in the tank of the water heater below approximately 145 psig while accommodating a volumetric expansion of the water in the tank associated with a rise in the temperature of the water by approximately 100 degrees Fahrenheit.

11. The thermal expansion arrester as in claim 9 wherein said second closure member is slidably and sealingly mounted within said tube.

12. In a water heater having a heating element and a water tank with a water inlet and a water outlet, the improvement comprising positioning within the tank a tube having a compressible volume of gas maintained therein between first and second closure members wherein at least one of said closure members is slidably and sealingly mounted within said tube.

13. The thermal expansion arrester as in claim 12 sized to maintain pressure in the water tank of the water heater below approximately 145 psig while accommodating a volumetric expansion of the water in the tank associated with a rise in the temperature of the water by approximately 100 degrees Fahrenheit.

14. The improved water heater as in claim 12 wherein said first closure member comprises a first piston having at least two O-rings extending around a piston body to form an airtight and watertight seal between said first piston and an internal surface of said tube.

15. The improved water heater as in claim 12 wherein said first closure member is secured within said tube by a first stop formed near a first end of said tube.

16. The improved water heater as in claim 15 wherein said first stop comprises an inwardly projecting rim of said tube.

17. The improved water heater as in claim 12 wherein said second closure member is slidably and sealingly mounted within said tube.

18. The improved water heater as in claim 17 wherein each of said first and second closure members comprises a piston having at least two O-rings extending around a piston body to form an airtight and watertight seal between said respective first and second piston and an internal surface of said tube.

19. The improved water heater as in claim 17 wherein said second closure member comprises a second piston secured within said tube by a second stop formed near a second end of said tube.

20. A method of accommodating the expansion of water within a tank of a water heater as the water is heated comprising the step of:

a) positioning within the tank a tube having a compressible volume of gas maintained therein between first and second closure members wherein at least one of said closure members is slidably and sealingly mounted within said tube; wherein said tube is not attached to any other structure within said tank.

* * * * *